United States Patent [19]

Aileo et al.

[11] 3,994,023

[45] Nov. 30, 1976

[54] SIMPLIFIED PROTECTIVE HELMET ASSEMBLY

[75] Inventors: Jackson A. Aileo, Carbondale; Leonard P. Frieder, Jr., Dalton, both of Pa.

[73] Assignee: Gentex Corporation, Carbondale, Pa.

[22] Filed: Oct. 23, 1975

[21] Appl. No.: 624,861

[52] U.S. Cl. ..... 2/417; 2/419

[51] Int. Cl.[2] ..... A42B 3/00

[58] Field of Search ..... 2/3 R, 3 A, 3 B, 3 C, 2/6

[56] References Cited

UNITED STATES PATENTS

| | | | |
|---|---|---|---|
| 2,455,797 | 12/1948 | Myers et al. | 2/6 |
| 2,573,250 | 10/1951 | Daly | 2/6 |
| 3,087,165 | 4/1963 | Cairns | 2/3 R |
| 3,241,154 | 3/1966 | Aileo | 2/3 C |
| 3,447,162 | 6/1969 | Aileo | 2/3 R |
| 3,600,713 | 8/1971 | Holt | 2/3 R |
| 3,685,055 | 8/1972 | Militello | 2/3 R |
| 3,897,596 | 8/1975 | Aileo et al. | 2/3 R |

FOREIGN PATENTS OR APPLICATIONS

| | | | |
|---|---|---|---|
| 1,163,574 | 9/1969 | United Kingdom | 2/3 R |

*Primary Examiner*—Alfred R. Guest
*Attorney, Agent, or Firm*—Shenier & O'Connor

[57] ABSTRACT

A simplified protective helmet of the type in which a molded relatively rigid frame for supporting the helmet headband, chin strap and crown assemblies is formed with an upwardly opening outer peripheral channel for receiving the edge of an outer ballistic shell and with a continuous flange extending generally upwardly and somewhat inwardly from the inner wall of the peripheral channel. The inner surface of the flange is formed with a plurality of spaced strap loop accommodating recesses and is provided with fastener elements at locations between the recesses. Respective adjustable loops at the ends of each of a number of crown straps are received by portions of a frame-carried cord extending across the strap loop accommodating recesses. Headband framing bodies carrying fastener elements are manually releasably secured to the flange carried fastener elements. Spacer elements may be provided between the flange and the headband bodies for smaller head sizes.

14 Claims, 9 Drawing Figures

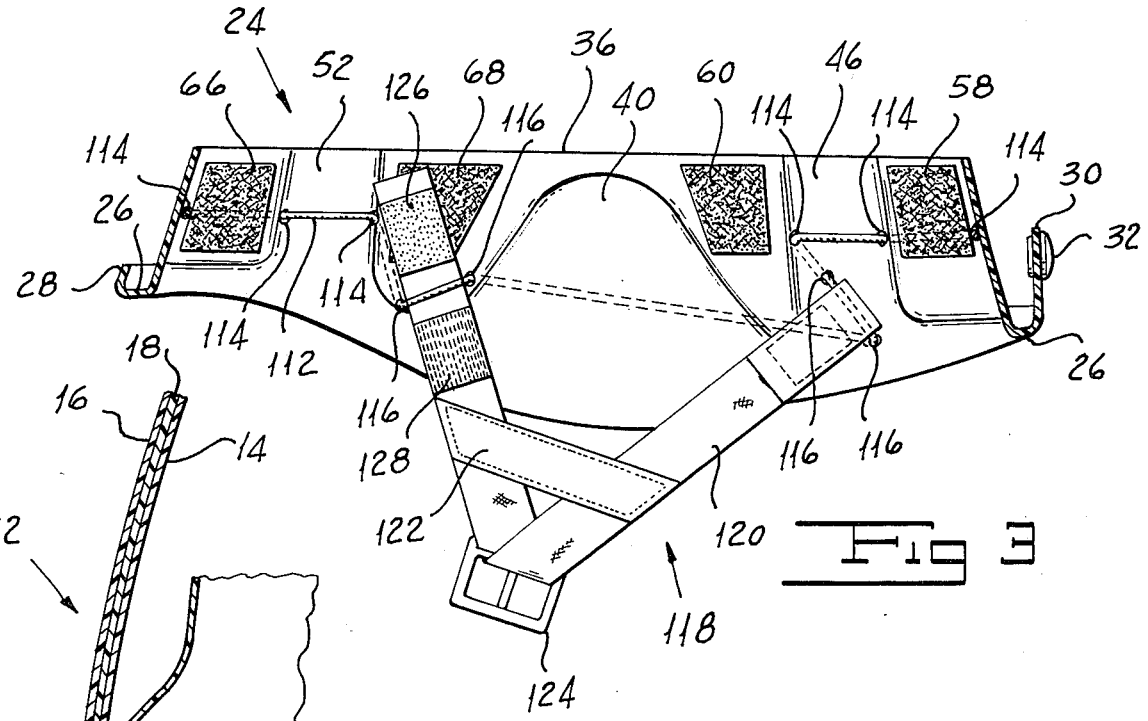
Fig 3
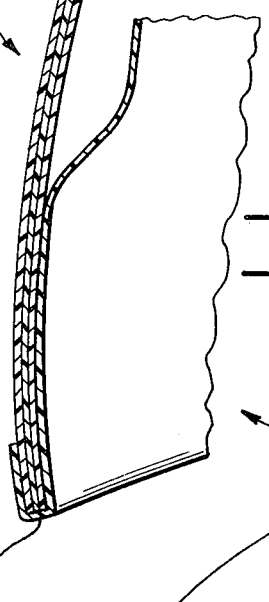
Fig 5
Fig 4
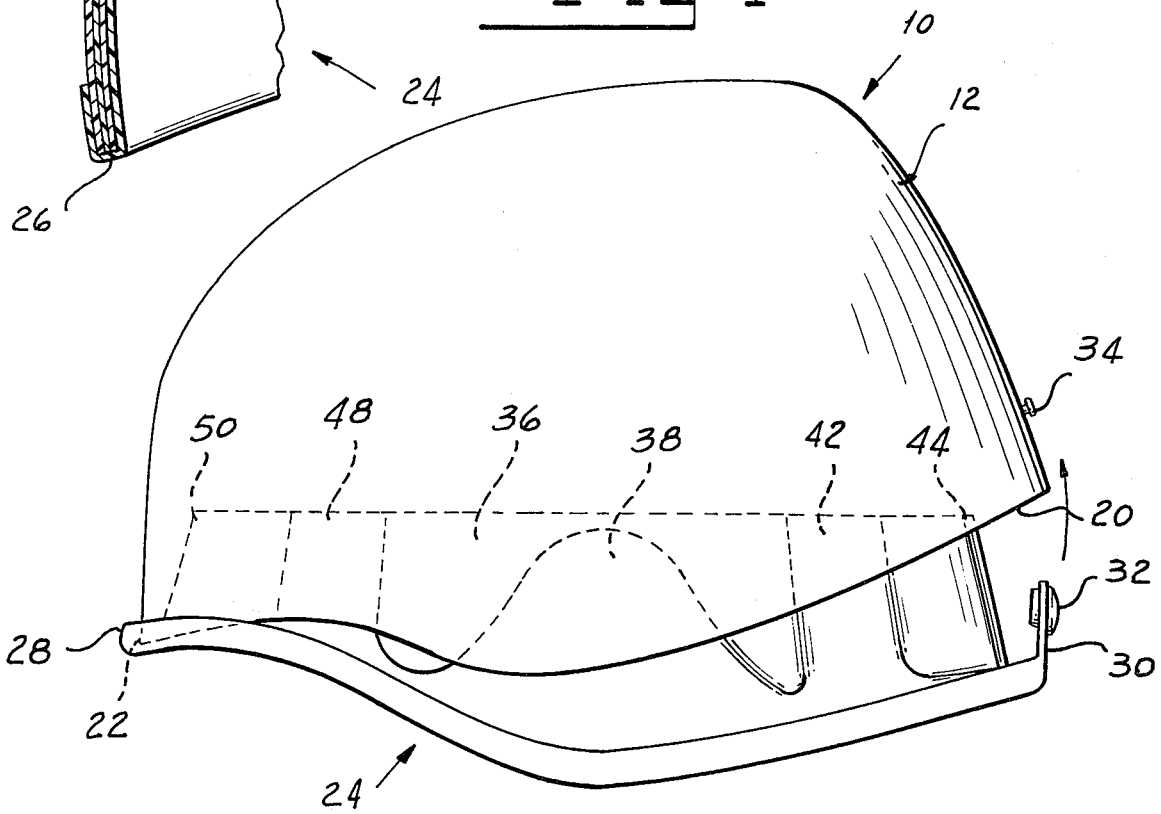

SIMPLIFIED PROTECTIVE HELMET ASSEMBLY

BACKGROUND OF THE INVENTION

This invention relates to a simplified protective helmet for use in military or other applications requiring protection of the head against ballistic impacts.

Our application entitled "Improved Protective Helmet," Ser. No. 500,547, filed Aug. 26, 1974, now Pat. No. 3,897,596, discloses a protective helmet of the type in which a headband assembly, chin strap assembly and crown assembly supporting frame molded of relatively rigid plastic material is provided with a peripheral channel for receiving the edge of a hard ballistic outer shell retained in assembled relationship with the frame by use of only a single fastener. A shoulder located inwardly of the peripheral channel is provided with a plurality of inwardly spaced upwardly and slightly inwardly directed fingers and with holes and channels which receive a cord by means of which the headband assembly and the chin strap are held in place. In the assembly shown in our co-pending application, envelopes formed of glove leather or the like receive soft spacer bodies which are slipped over the fingers and which are secured to the frame by means of snap fasteners carried by the flaps on the envelopes and by the frame to cooperate with the fingers to form the headband of the assembly. Each of the crown assembly straps includes a permanent loop at one end, which is received by a portion of the cord on the outside of the frame shoulder, and an adjustable loop at the other end thereof, which is received by another portion of the cord on the outside of the shoulder.

While the improved protective helmet of our co-pending application successfully achieves the result of providing a ballistic helmet which is capable of mass production at relatively low cost, while at the same time avoiding the danger of injury to the head of the wearer as a result of fastener elements and the like in the hard outer shell, which may act as secondary missiles, it is not as convenient in use as is desired. First, it does not permit the crown straps to be adjusted without removing the frame from the hard ballistic outer shell. Secondly, the assembly of the envelopes and pads on the resilient fingers is relatively cumbersome in use. Not only does the assembly not accommodate as wide a range of head sizes as is desirable, but also adjustment of head sizes is relatively difficult.

SUMMARY OF THE INVENTION

One object of our invention is to provide a simplified protective helment which permits adjustment of the length of the crown straps without disassembling any parts of the helmet.

Another object of our invention is to provide a simplified protective helmet which readily accommodates a wide range of head sizes.

A further object of our invention is to provide a simplified protective helmet in which change in the head size thereof is accomplished in a rapid and expeditious manner.

Other and further objects of our invention will appear from the following description.

In general, our invention contemplates the provision of a simplified protection helmet of the type in which a molded frame for supporting the headband assembly, the chin strap assembly, and the crown assembly is molded from relatively rigid material with a peripheral upwardly opening channel for receiving the edge of a hard ballistic outer shell. The frame is formed with a continuous flange extending generally upwardly and slightly inwardly from the inner wall of the peripheral channel. The inner surface of the flange is formed with a plurality of spaced recesses across which a cord threaded through holes in the flange extends so that a portion of the cord across one of the recesses receives an adjustable loop at one end of a crown strap and another portion of the cord in another recess receives an adjustable loop at the other end of the crown strap. Fastener elements are secured to the inner surface of the flange at locations between the recesses to receive complementary fastener elements carried by headband forming elements. Where required, intermediate spacer members are inserted between the frame-carried elements and the elments on the headband forming members.

BRIEF DESCRIPTION OF THE DRAWINGS

In the accompanying drawings which form part of the instant specification and are to be read in conjunction therewith and in which like reference numerals are used to indicate like parts in he various views:

FIG. 3 is a section of our protective helmet taken along line 3—3 of FIG. 1 and drawn on a reduced scale.

FIG. 4 is a side elevation illustrating the manner in which the shell is assembled with the frame.

FIG. 5 is a fragmentary section showing the preferred form of the ballistic outer shell incorporated in our protective helmet.

Referring now to FIGS. 1 to 5 of the drawings, our simplified protective helmet, indicated generally by the reference character 10, includes a rigid outer shell, indicated generally by the reference character 12, having suitable ballistic properties. Preferably, the shell is made up of respective inner and outer shells 14 and 16 formed from a suitable material such as a polycarbonate resin provided with a coating of a suitable elastomer applied to the shells either by compression molding or by a spray coating or dip coating method. Sandwiched between the shells 14 and 16 is a layer 18 of ballistic material. While any high elongation, high tensile strength fibrous material having a high melting point may be employed, preferably, we select one of the "aromids" which include aromatic polyimide resins developed by E.I. duPont de Nemours & Company and sold under the trademarks "Kevlar" and "Nomex". The fibrous material making up the center layer 18 may be either a woven material, a needlepoint felt, or a fibrous material loosely bound together by the use of any suitable binder. We form the outer shell with an edge 20 having a slightly outwardly-directed portion 22 at the front of the helmet.

Figure 1:
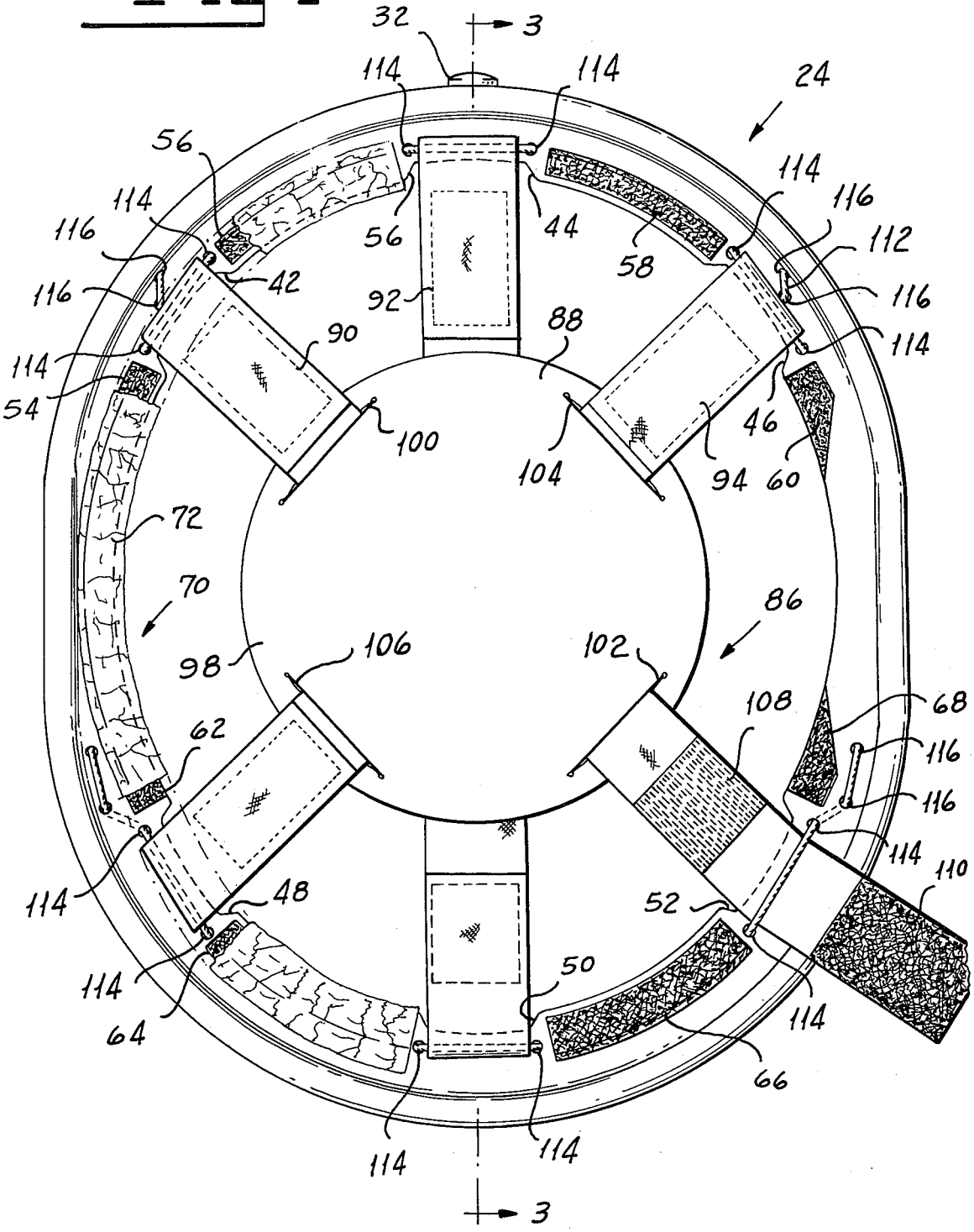
FIG. 1 is a bottom plan of our protective helmet with the ballistic outer shell and the chin strap supports removed.

Our helmet also includes a suspension frame, indicated generally by the reference character 24, formed of any suitable synthetic resin. This frame 24 has a peripheral channel 26, a portion 28 of which adjacent to the front of the frame is slightly inwardly directed. In assembling the outer shell 12 on the frame 24, the edge portion 22 is inserted in the channel portion 28 in the manner illustrated in FIG. 4, and the shell can then be swung down to a position at which the edge 20 is received in the channel 26 around the entire periphery of the helmet. When the outer shell 12 has thus been assembled relationship by use of a single fastener. In the particular embodiment illustrated in the drawings, an upwardly-directed extension 30 at the back of the frame 24 carries a female fastener element 32 for receiving a male fastener element 34 secured to the outer shell.

We mold the frame 24 from a relatively rigid material with a generally upwardly and slightly inwardly directed flange 36 forming a continuation of the inner wall of channel 26. Flange 26 prevents bottoming of the helmet on the wearer's head as a result of a blow on the side of the outer shell. Thus, the wearer's head is protected against injury which might otherwise result from the hard outer shell being driven into engagement with his head.

We form the inner surface of flange 36 with ear receiving recesses 38 and 40 and with spaced upwardly extending channels or recesses 42, 44, 46, 48, 50 and 52 for receiving the straps of a crown structure to be described.

We secure a plurality of headband assembly fastener elements 54, 56, 58, 60, 62, 64, 66 and 68 to the inner surface of flange 36 between the recesses therein by any suitable adhesive or the like. The fastening elements may be of any suitable readily manually actuatable type such, for example, as strips of hook-and-loop type fastening material sold by the American Velcro Company under the trademark "Velcro". The frame fastening strips are all of the same type, either hook or loop.

Referring now to FIGS. 1, 3 and 6 to 9, the headband assembly of our helmet includes identical left and right headband pads, only the left pad of which is shown and is indicated generally by the reference numeral 70. Each of the pads 70 includes an outer skin 72 formed of a suitable material such as glove leather adhered to an inner layer 74 of any suitable relatively soft material such as formed natural or synthetic rubber. We adhere or otherwise secure to the back of the inner foam layer a hook-and-loop type fastening strip 76 complementary in type to the strip 54 provided on the flange 36. The left headband pad 70 is releasably secured to the frame 24 by mating the fastening strip 76 with the complementary strips 54, 56, 62 and 64 located on the inner surface of the upwardly extending flange 36. Similarly, the right headband pad (not shown) is secured by mating the pad fastening strip 76 to flange fastening strips 58, 60, 66 and 68. So attached, these pads form the helmet headband. By vertically offsetting the pads 70 with respect to the flange fastening strips, it is possible to match the effective band size to the head of the wearer, since the circumference of the flange 36 decreases toward the top.

If necessary, further adjustment in the effective band size may be effected by using one or more spacer pads, indicted generally by the reference character 78. These pads are of approximately the same width and thickness as the headband pads 70, but are shorter and comprise an inner layer 80 of foam rubber sandwiched between complementary fastener strips 82 and 84 similar in composition to the strips 76 and the frame strips, respectively. The parts of the pad 78 are held in assembled relationship by any suitable means such as by an adhesive. The spacer pads 78 are used to provide additional head size flexibility by inserting them between the headband pads 70 and the flange 36 to decrease the effective band circumference. For example, a spacer pad 78 may be secured to the front portion of the frame by mating the spacer pad fastening strip 82 with the flange fastening strips 64 and 66. The headband pads 70 may then be secured to the frame 24 in the usual manner, the headband pad fastening strips 76 being mated with the spacer pad fastening strip 84 in the same manner as they would normally be mated with the flange fastening strips 64 and 66, respectively.

Our helmet includes a crown structure, indicated generally by the reference character 86, comprising a central portion 88 and a plurality of straps 90, 92 and 94 for attaching the central portion 88 to the frame 24. The central portion 88, formed of a shock absorbing foam rubber top layer 96 supported by a bottom layer 98 of leather or the like, is provided with slits 100, 102, 104 and 106 for receiving straps 90 and 94, respectively. Strap 92 is secured to the central portion 88 by passing it between straps 90 and 94 and the foam rubber layer 96 of the central portion. We stitch or otherwise secure in spaced relationship adjacent each end of the straps 90, 92 and 94 complementary strips 108 and 110 of fastening material of the type described earlier to form adjustable loops at said strap ends.

The crown structure 86 is secured to the frame 24 by means of a cord 112 threaded around the flange 36. The cord 112, formed of any suitable material such as braided nylon yarn, runs generally along the outside of the frame 24, but is passed through holes 114 located on either side of the channels 42, 44, 48, 50 and 52 to run along the inside of the frame 24 across these channels. The straps 90, 92 and 94 are attached to the frame 24 by passing their ends around the portions of the cord 112 running inside the channels 42, 44, 46, 48, 50 and 52 and engaging fastener strips 108 and 110. Thus, strap 90 is secured within channels 42 and 52, strap 92 is secured within channels 44 and 50, and strap 94 is secured within channels 46 and 48. By suitable aligning the fasteners 108 and 110 when the straps are secured within the channels, the height of the crown structure 86 may be adjusted to the head of the wearer. Because the straps 90–94 are recessed in the channels 42–52, they do not interfere with the placement of the headband pads 70.

Referring now to FIGS. 1 and 3, the cord 112 also passes through four pairs of holes 116 to provide securing points on the inside of the frame for a pair of left and right chin strap supports, only the right hand one of which is shown and is indicated generally by the reference character 118. Holes 116 are located below the flange fastening strips 54 and the like to permit attachment or removal of the chin strap supports independently of the headbands pads 70. Chin strap supports 118 may be made up of a length of nylon webbing 120 folded to form a vee, the legs of which are connected by a crosspiece 122 secured to the webbing 120. The portion of the webbing 120 at the apex of the vee receives a securing element of any suitable type such as a buckle 124. We stitch otherwise secure a pair of complementary fastener strips in spaced relationship to each leg of the webbing 120 adjacent to the end thereof. The legs are secured to the inner surface of the frame 24 by passing the ends around the portions of the cord extending along the inner surface of flange 36 between adjacent holes 116 and mating the fastening strips.

Figure 2:
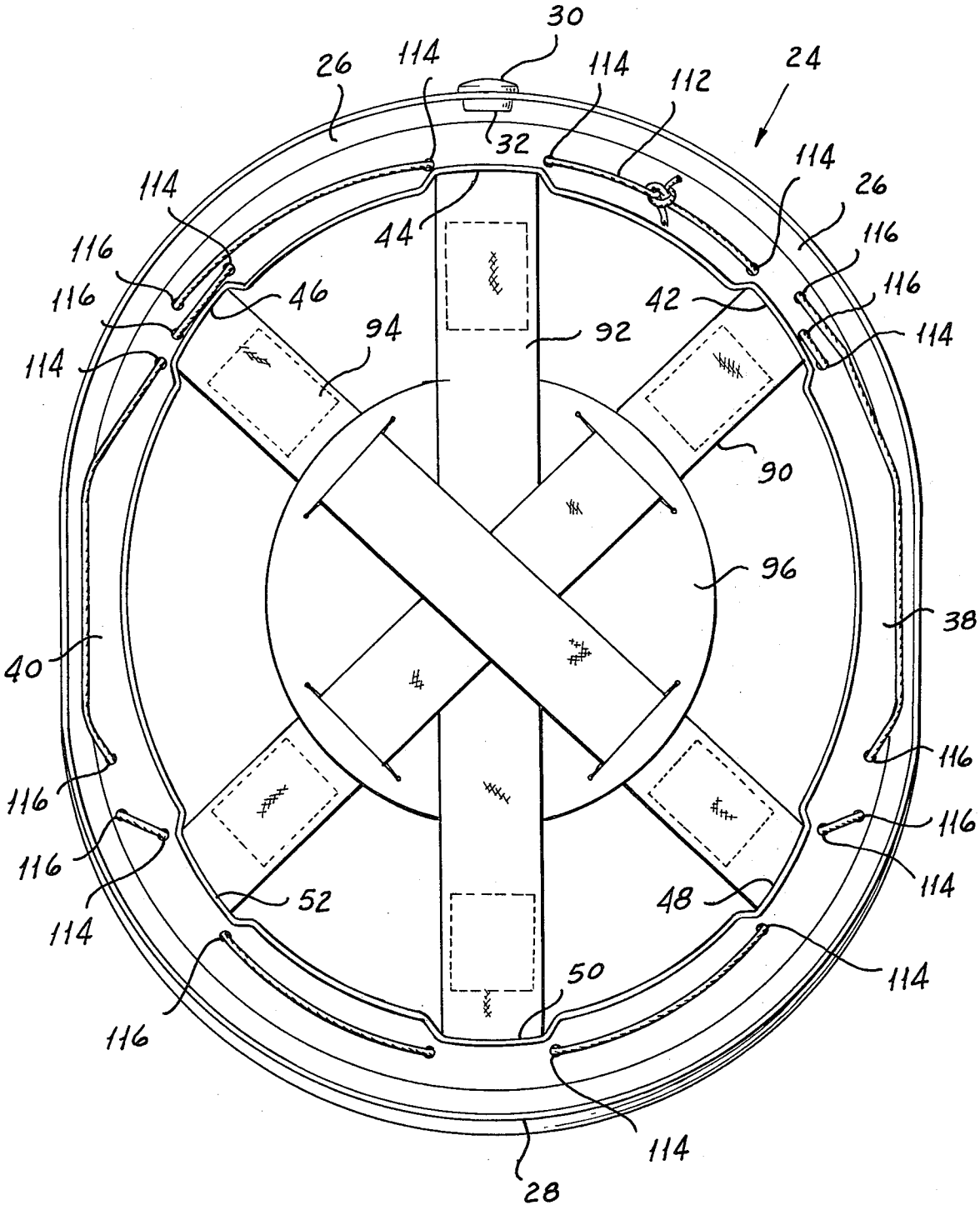
FIG. 2 is a top plan of our protective helmet with the outer shell removed.
Figure 6:
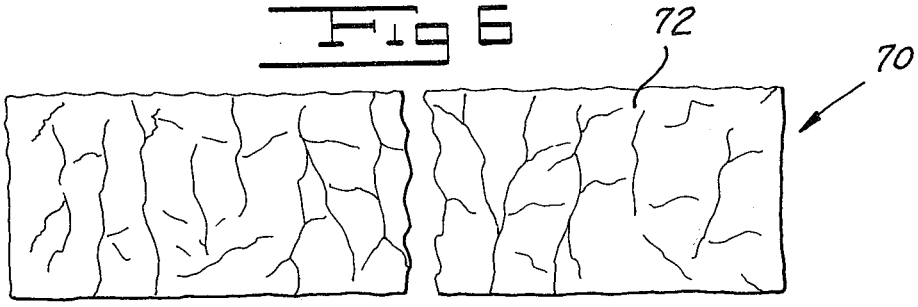
FIG. 6 is a fragmentary top plan of the headband pad used in our protective helmet.
Figure 7:
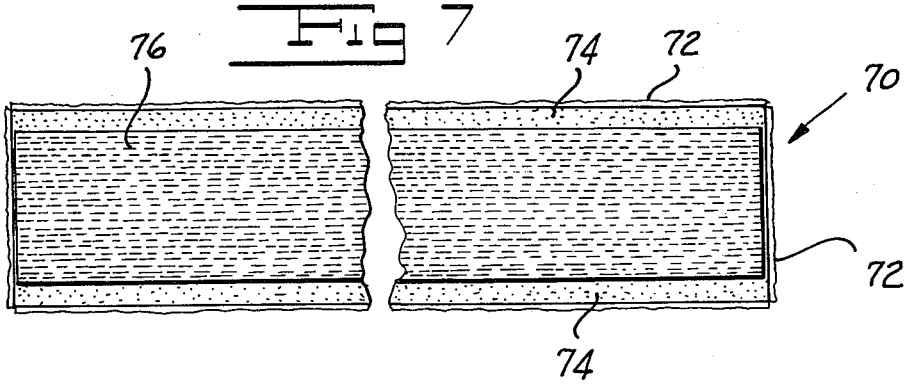
FIG. 7 is a fragmentary bottom plan of the headband pad shown in FIG. 6.
Figure 8:
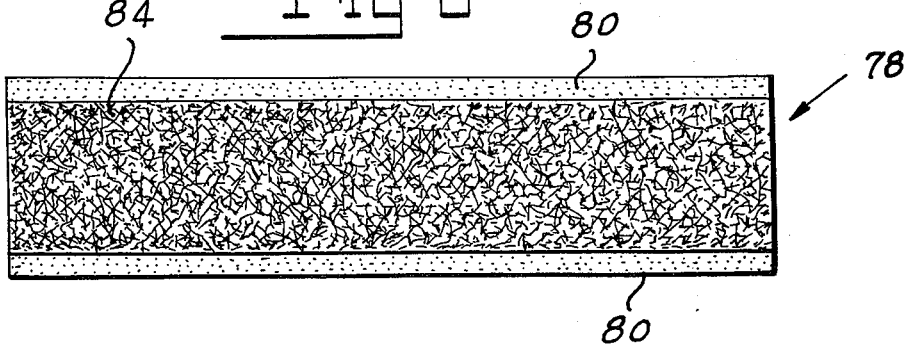
FIG. 8 is a top plan of the spacer pad used in our protective helmet.
Figure 9:
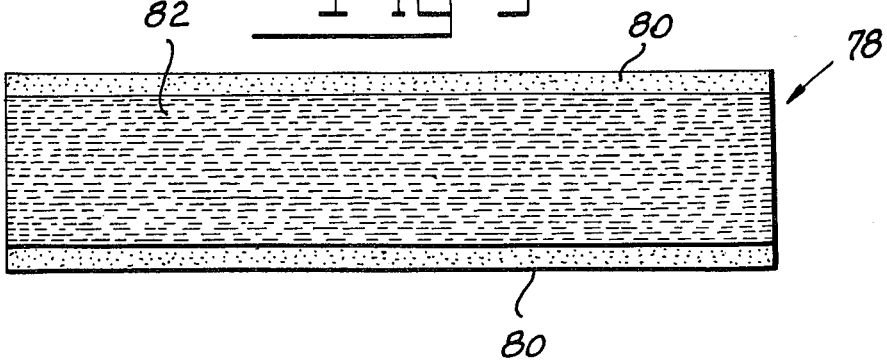
FIG. 9 is a bottom plan of the spacer pad shown in FIG. 8.

In assembling the components of our improved protective helmet 10, the cord 112 is first threaded through the openings 114 and 116 as shown in FIGS. 1-3 so that the cord 112 runs along the inner surface of the flange 36 between adjacent pairs of holes 114 and 116. The chin strap supports 118 and the crown structure 86 are then secured to the frame 24 by securing the ends of the nylon webbing 120 and the crown straps 90–94, respectively, around the respective segments of the cord 112. Finally, a suitable combination of headband pads 70 and spacer pads 78 are secured to the inner surface of the annular portion 36.

To secure the outer shell 12 to the inner frame 24, the slightly outwardly directed portion 22 of the shell 12 is inserted into the slightly inwardly directed portion 28 of the channel 26 of the frame 24. When that has been done in the manner illustrated in FIG. 4, the body is swung downwardly to a position at which its edge is received in the channel 26 around its entire periphery. In this position of the parts, the fastener elements 32 and 34 can be engaged so as securely to hold the body 12 in assembled relationship with the frame 24.

When it is being worn, the helmet is held on the wearer's head by any suitable chin strap supported on the frame by the lengths of webbing 120. The flange portion 36, which is to some degree flexible, absorbs the force of impact of a blow or the like on the helmet and prevents the helmet from bottoming. If one desires to change the number of spacer pads to accommodate a different head size, the sizing and spacer pads can readily be detached from the frame. Similarly, if it becomes necessary to clean or to replace or repair the crown structure 88 or the chin strap supports 118, they may be removed from the frame 24 by detaching straps 90–94 or webbing 120, respectively; owing to the placement of the supporting segments of the cord 112 inside of the flange 36, it is unnecessary either to untie the cord 112 or to move the outer shell 12 from the frame 24.

It will be seen that we have accomplished the objects of our invention. We have provided a simplified protective helmet which readily accommodates a wide range of head sizes. The crown structure of our helmet may readily be adjusted without separating the supporting frame from the hard outer shell. All of the headband, chin strap and crown assemblies may readily manually be removed from the frame for cleaning or replacement.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A protective helmet assembly comprising in combination:

a. a ballistic shell having a peripheral edge;

b. a frame having an upwardly opening peripheral channel for receiving said edge, said frame having a flange extending generally upwardly and inwardly from the inner wall of said channel;

c. means for securing said shell and said frame in assembled relationship with said edge in said channel;

d. a crown strap having a loop at each end thereof, at least one of said loops being adjustable; and e. means for receiving each of said crown strap loops at spaced locations on the inner surface of said flange.

2. An assembly as in claim 1 in which each of said loops is capable of being manually opened to permit removal from said loop receiving means.

3. An assembly as in claim 1 in which the inner surface of said flange is formed with a plurality of spaced recesses for receiving said crown straps, and comprising a resilient headband pad and means for manually releasably securing said headband pad to the inner surface of said flange.

4. An assembly as in claim 3 comprising a resilient spacer pad and means for manually releasably securing said spacer pad between said headband pad and the inner surface of said flange.

5. An assembly as in claim 3 in which said releasable securing means comprises complementary strips of hook-and-loop type fastener elements secured to said headband pad and to the inner surface of said flange, respectively.

6. An assembly as in claim 3 in which said loop receiving means comprises cord segments extending across each of said recesses.

7. An assembly as in claim 3 in which said flange is provided with holes at the sides of each of said spaced recesses, and in which said loop receiving means comprises a cord threaded around the frame with portions thereof threaded through said holes to extend across said recesses to receive said crown strap loops.

8. An assembly as in claim 7 which further comprises a pair of chin strap supports, each of which is formed with a pair of loops for attachment to the frame; in which said frame is provided with pairs of holes at chin strap support locations on the inner surface thereon; and in which portions of said cord are threaded through said holes to extend across said chin strap support locations to receive said loops.

9. An assembly as in claim 8 in which said chin strap support locations are located below the headband pad securing means.

10. An assembly as in claim 8 in which at least one of each of said pairs of chin strap loops is adjustable.

11. An assembly as in claim 8 in which each of said chin straps loop is capable of being readily manually opened to permit removal of said loop from said cord.

12. An assembly as in claim 8 in which each of said chin strap loops comprises complementary strips of hook-and-loop type fastener material.

13. A protective helmet assembly which comprises:

a. a ballistic shell having a peripheral edge;

b. a frame having an upwardly opening peripheral channel for receiving said edge, said frame having a continuous flange extending generally upwardly and inwardly from the inner wall of said channel, said flange having a strip of hook-and-loop type fastener elements secured to its inner surface;

c. a resilient headband pad for placement between said flange and the head of a wearer, said paid having a strip of hook-and-loop type fastener elements secured to one side thereof, said fastener elements being complementary in type to the fastener elements secured to the inner surface of the flange; and d. means for securing said shell and said frame in assembled relationship with said edge in said channel.

14. An assembly as in claim 13 which further comprises a resilient spacer pad for placement between said flange and said headband pad, said spacer pad having complementary strips of hook-and-loop type fastener elements secured to the opposite sides thereof for releasable attachment to the fastening strips provided on said flange and said headband pad, respectively.

* * * * *